United States Patent [19]

Carternock

[11] 4,231,678

[45] Nov. 4, 1980

[54] PAVING MACHINES

[75] Inventor: Frederick A. Carternock, Dover, England

[73] Assignee: Integrated Technology Limited, St. Peter Port, Guernsey, Channel Islands

[21] Appl. No.: 907,091

[22] Filed: May 16, 1978

[30] Foreign Application Priority Data

May 17, 1977 [GB] United Kingdom ..... 20666/77
Aug. 4, 1977 [GB] United Kingdom ..... 32740/77

[51] Int. Cl.[2] ..... E01C 19/28
[52] U.S. Cl. ..... 404/103; 404/122
[58] Field of Search ..... 404/103, 102, 101, 96, 404/106, 108, 110, 118, 119, 104, 98, 83, 122

[56] References Cited

U.S. PATENT DOCUMENTS

| | | | |
|---|---|---|---|
| 1,767,243 | 6/1930 | Kime | 404/110 |
| 2,094,910 | 10/1937 | Baily | 404/96 |
| 2,284,550 | 5/1942 | Adams | 404/84 X |
| 2,757,587 | 8/1956 | Mentes | 404/110 X |
| 2,953,977 | 9/1960 | Warren | 404/110 |
| 2,954,241 | 9/1960 | Warren | 404/110 X |
| 3,054,334 | 9/1962 | Barber | 404/108 |
| 3,213,769 | 10/1965 | Smith | 404/110 |
| 3,228,310 | 1/1966 | Cartwright | 404/110 |
| 3,229,601 | 1/1966 | Philpott | 404/103 |
| 3,246,584 | 4/1966 | Lee | 404/110 |
| 3,907,451 | 9/1975 | Fisher | 404/118 X |
| 3,967,912 | 7/1976 | Parker | 404/108 X |
| 3,989,402 | 11/1976 | James | 404/110 |
| 4,029,165 | 6/1977 | Miller | 404/98 X |

*Primary Examiner*—Nile C. Byers, Jr.

[57] ABSTRACT

Road surfacing machine having a front support (e.g. wheels) and a rear support (e.g. a rotatable roller) on which it can move along a road to be surfaced thereby. The body of the machine, which includes a hopper for storing material to be laid and an outlet for discharging it, is supported on the supports. Metering means (e.g. a screed plate) is positioned between the supports and serves to form a layer of selected thickness and shape of the said material on the road base. Bearing means (e.g. horizontal pivots) enable free relative angular movement between the front support on the one side and the metering means and a rear support on the other side about a longitudinal axis and about a transverse axis. Also a road surfacing machine having a front support, a hopper and a screed member, and including profiling means which comprise means for indicating the height and means for indicating the angle of inclination of the screed member.

10 Claims, 17 Drawing Figures

PAVING MACHINES

The invention relates to a road surfacing machine arranged for movement along a road to be surfaced. The machine is referred to, for simplicity, as a road surfacing machine. It will be understodd that the machine is suitable for laying layers of various materials e.g. for sub-bases, bases, base courses, wearing courses, foundations, ground bases, surface dressings or anti-skid surfaces e.g. for roads, pavements, runways, car parks, playgrounds, sports grounds, reservoir bottoms or industrial floors, and the specification and claims should be interpreted correspondingly.

Known road surfacing machines have a front support which travels on the uneven road base and a screed plate positioned behind the front support when viewed in the direction of movement. In operation the front support travels on the uneven surface of the road base so that the unevenness of the road base is fully transmitted to the screed plate, which must be continuously readjusted to compensate for 100% of the unevenness.

Further in these machines the screed plate cannot be moved during laying sideways relative to the rest of the machine so that it cannot avoid obstacles and be used to compensate for sideways deflections from the ideal path of travelling of the machine. Moreover known machines have no compacting means so that a separate compacting machine must be used therewith.

The aim of the present invention is to devise a road surfacing machine which does not have or at least mitigates the above disadvantages of known machines.

The invention provides a road surfacing machine arranged for movement along a road to be surfaced, the machine comprising a body including a hopper for storing material to be laid and outlet means for allowing discharging of the material from the hopper, a front support and a rear support, the body being supported on said supports, metering means positioned between the front and rear supports for forming a layer of selected thickness and shape of the surfacing material discharged from the outlet means, and bearing means enabling free relative angular displacement between the front support and the metering means and the rear support about a longitudinal axis contained in or parallel to the vertical plane of symmetry of the machine, and about a transverse axis perpendicular to that plane.

Figure 1:
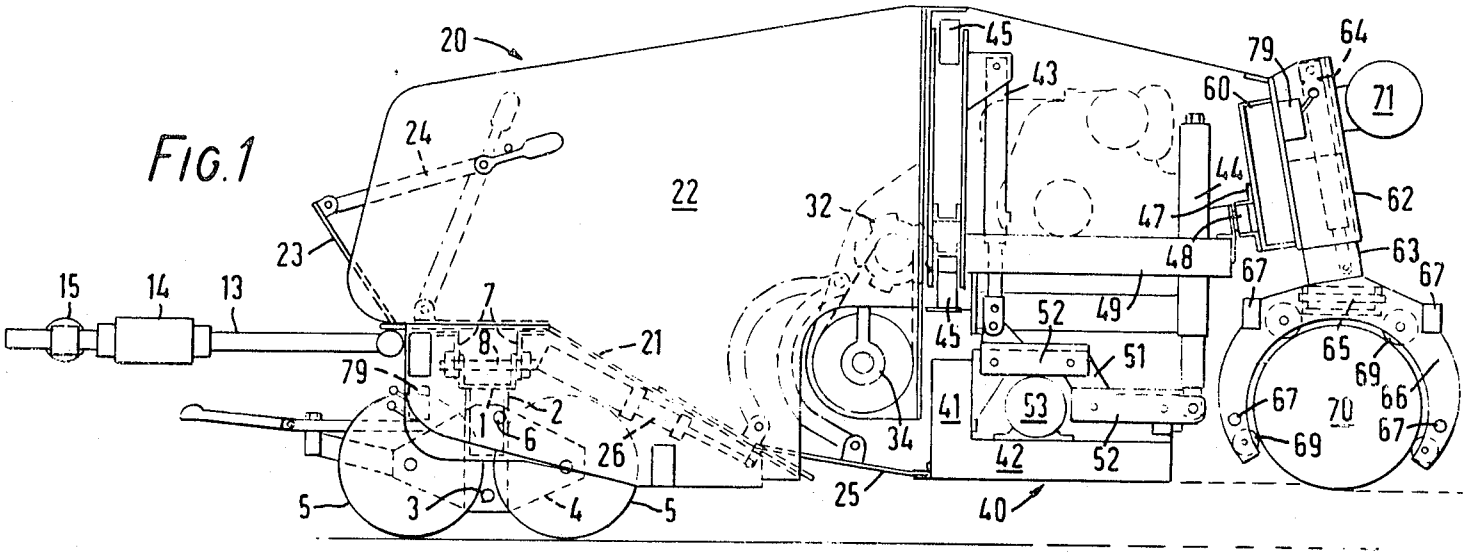
Figure 2:
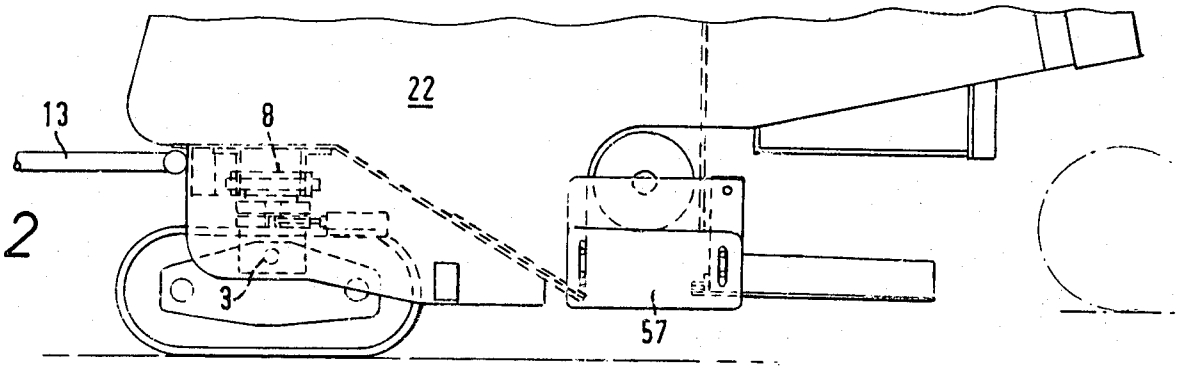
Figure 3:
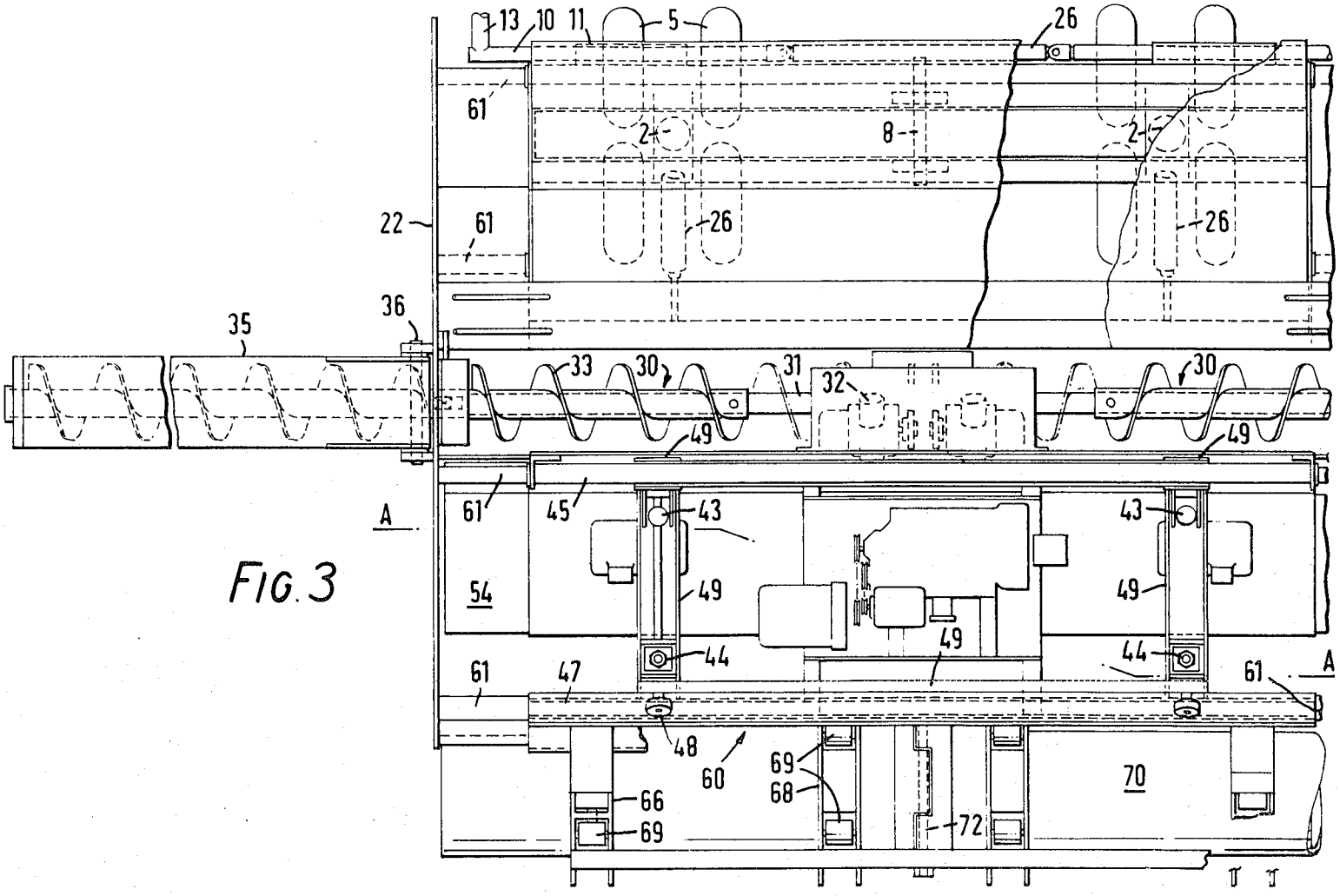
Figure 4:
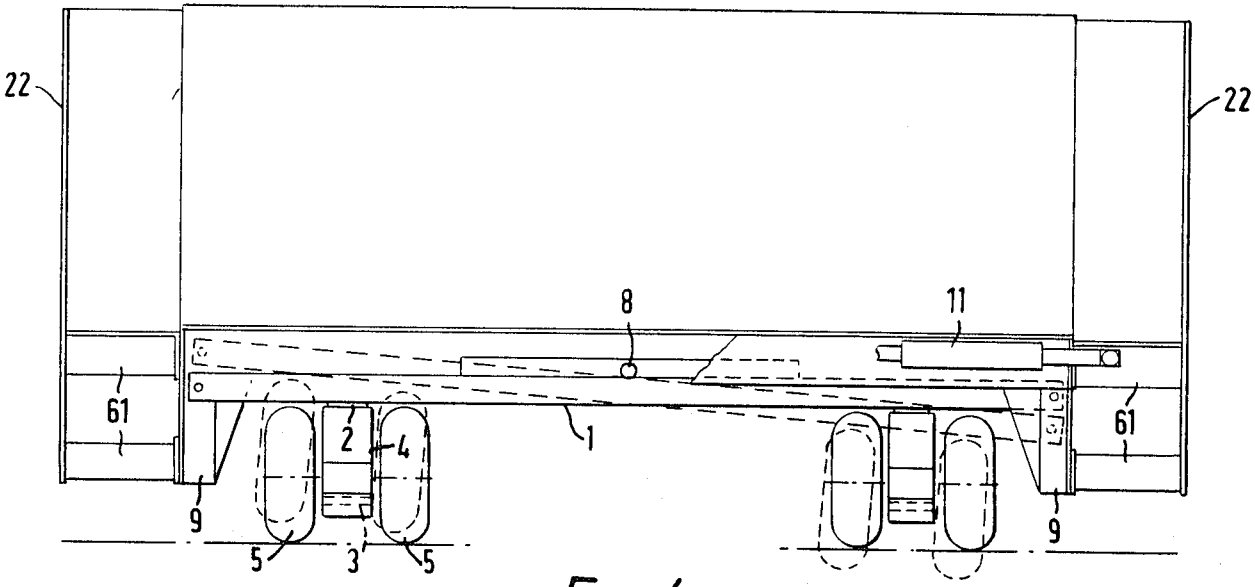
Figure 5:
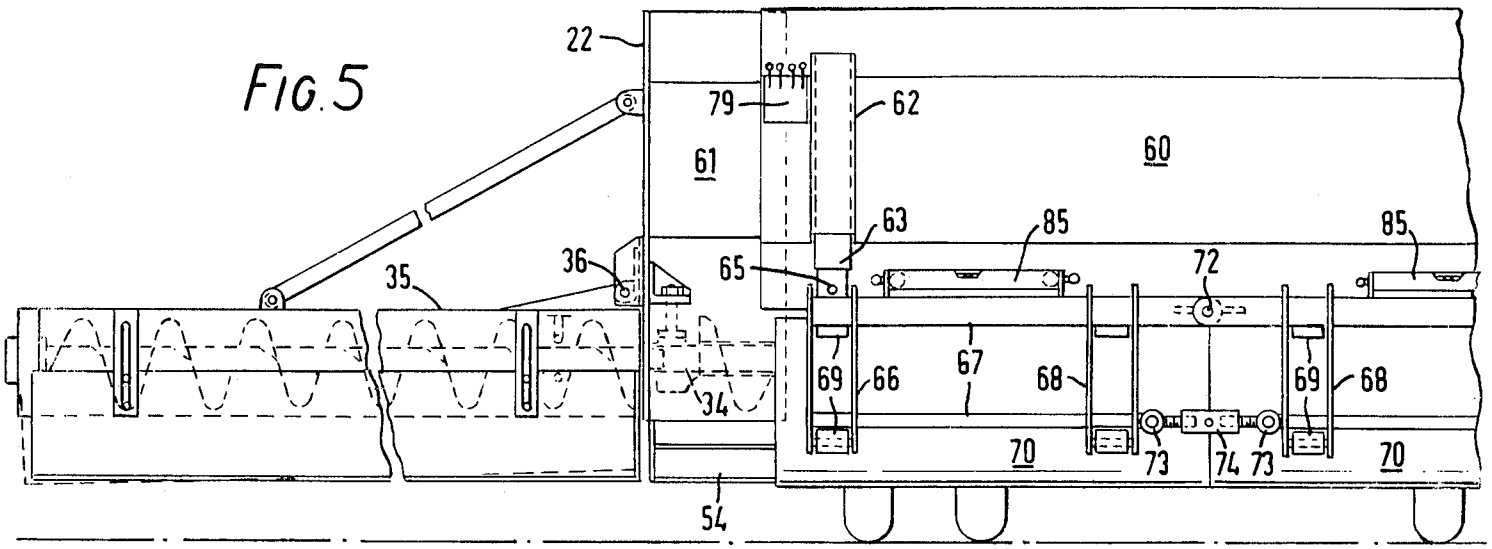
Figure 6:
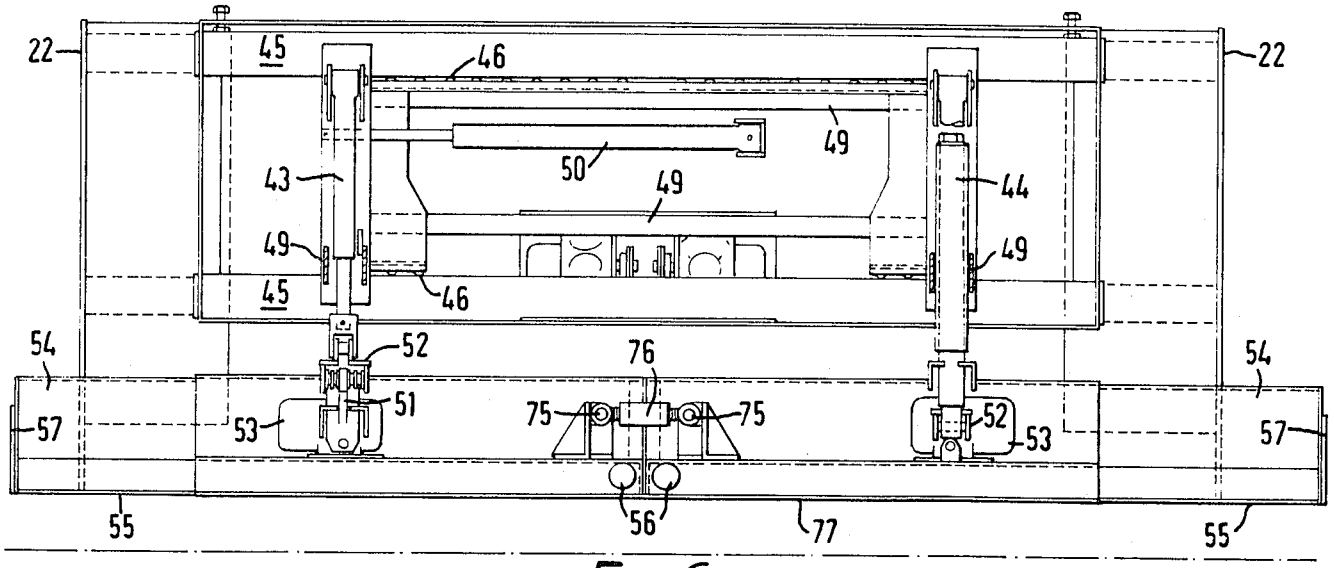
Figure 7:
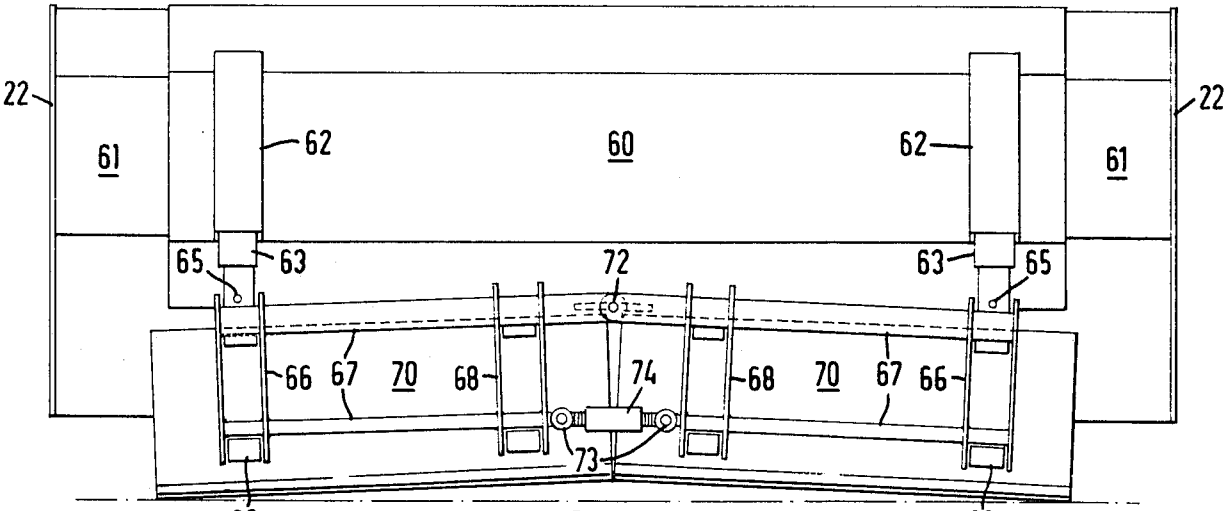
Figure 8:
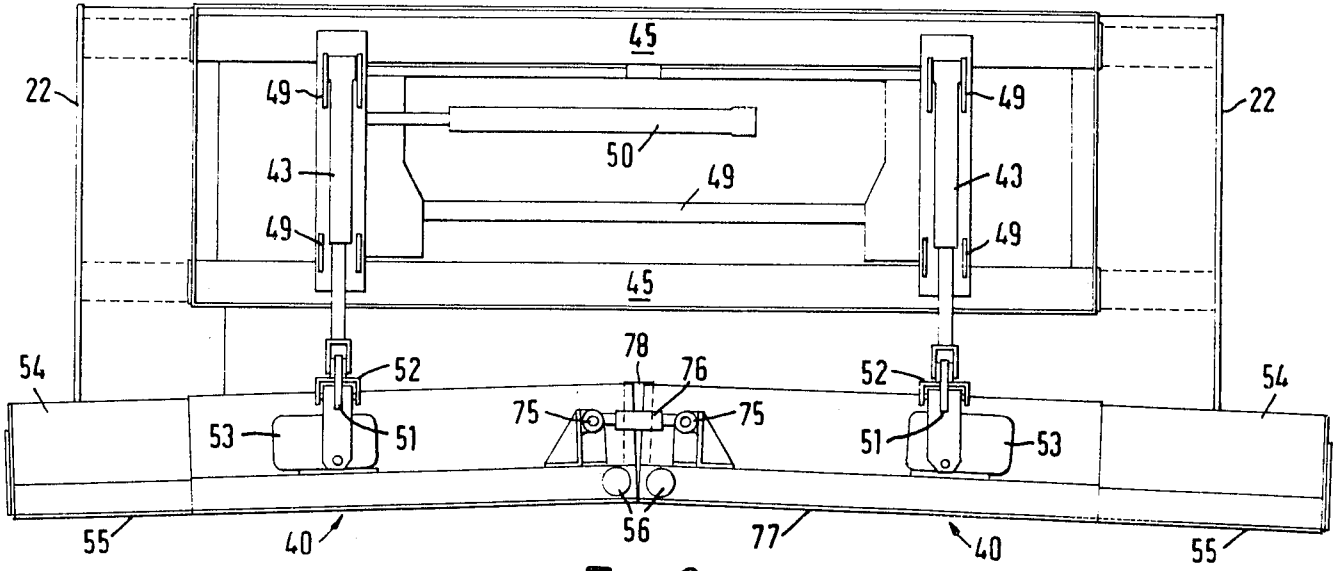
Figure 9:
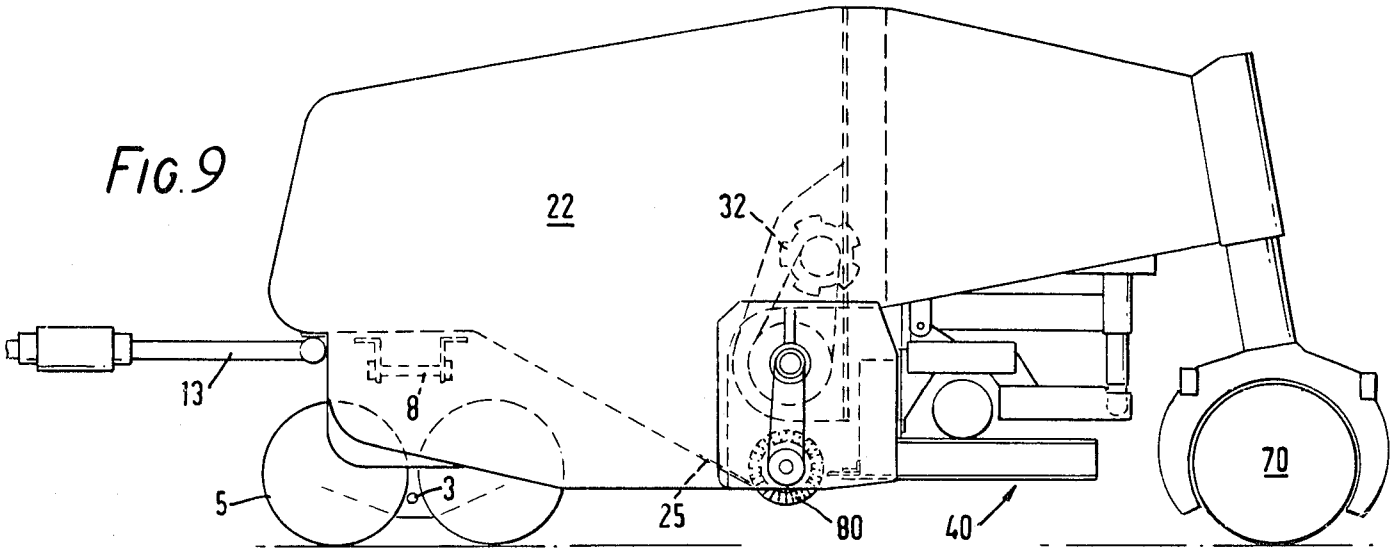
Figure 10:
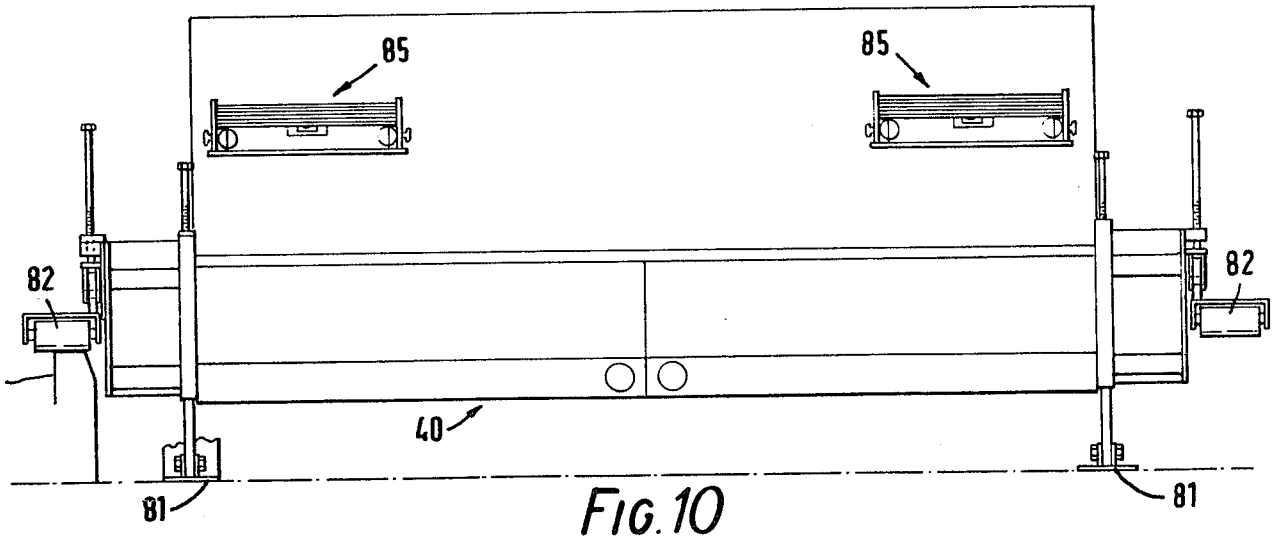
Figure 11:
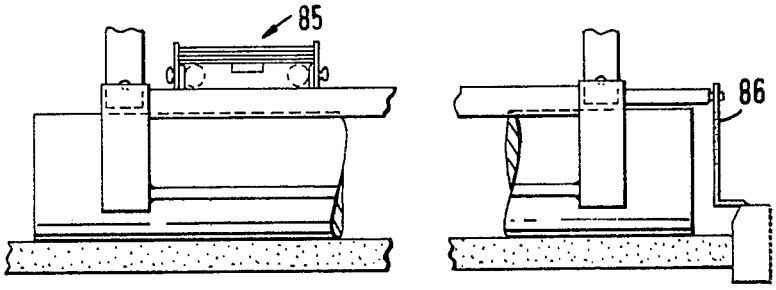
Figure 12:
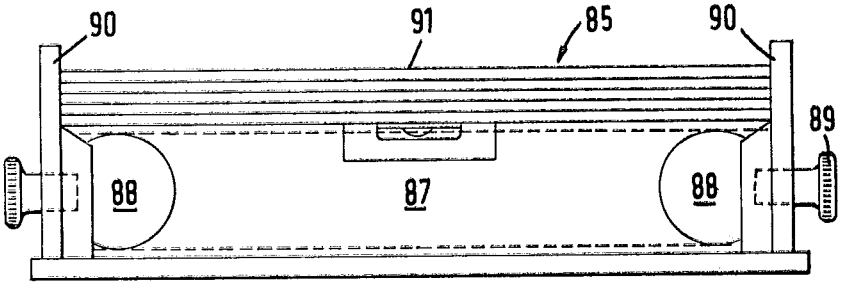

The invention will now be described, by way of example, with reference to the accompanying diagrammatic drawings, in which:

FIG. 1 is a side view, partly in section, of a road surfacing machine the undercarriage of which is supported on wheels, FIG. 2 is a detail showing an undercarriage supported on track units, FIG. 3 is a plan view, partly in section, FIG. 4 is a front view, partly in section, FIG. 5 is a rear view, partly in section, showing a rear roller support in straight position, FIG. 6 is a section along line A—A in FIG. 3 showing a screed plate in straight position, FIG. 7 is a rear view, similar to FIG. 5, showing the rear roller support in crowned position, FIG. 8 is a section showing the screed plate in crowned position, FIG. 9 is a side view, partly in section, showing a fluted roller positioned between the screed plate and the hopper outlet, FIG. 10 is a rear view, partly in section, showing alternative rear supports, FIG. 11 is a diagrammatic representation of profiling means on the rear support, FIG. 12 shows a graduated scale in conjunction with a spirit level.

Figure 17:
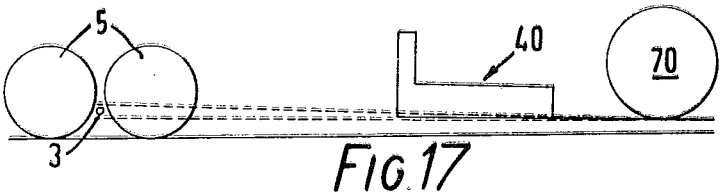
Figures 13, 14, 15, 16:
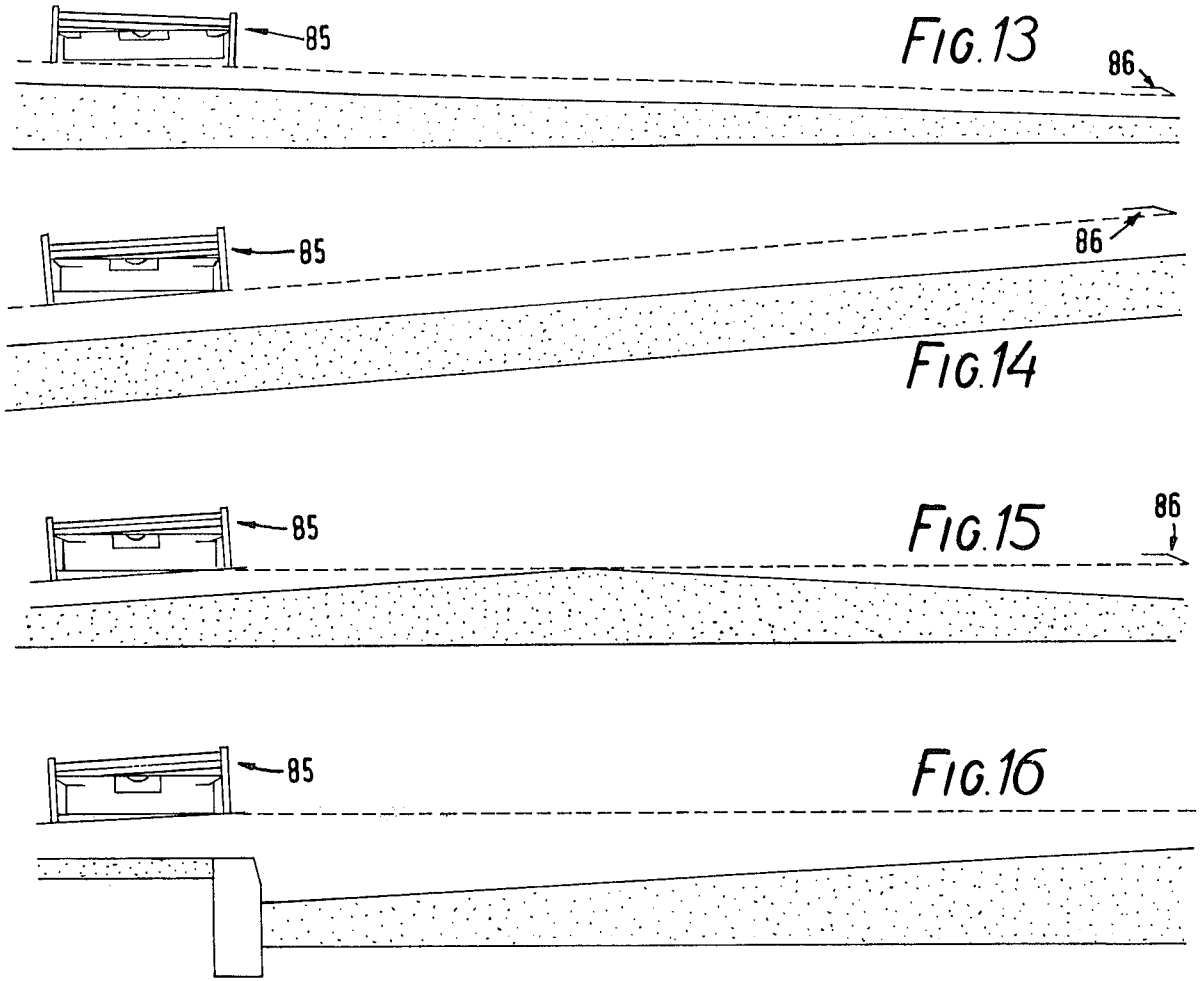

FIG. 13 shows adjustment of the profiling means for laying a layer having an inclined surface onto a horizontal road base, FIG. 14 shows adjustment of the profiling means for laying a layer having an inclined surface onto an inclined road base, FIG. 15 shows adjustment of the profiling means for laying a layer having a crowned surface onto a horizontal road base, FIG. 16 shows adjustment of the profiling means for laying a layer having an inclined surface onto a horizontal road base and simultaneously a horizontal surface onto a horizontal pavement base, and FIG. 17 shows a principle of working of a machine according to the invention.

The illustrated machine comprises an undercarriage shown in FIGS. 1–4 comprising a transverse beam 1 formed by a channel section the web of which extends horizontally and the flanges of which extend vertically. The undercarriage is carried by a front support which in the variant shown in FIGS. 1, 3 and 4 is formed by two wheel units. Each wheel unit comprises an upright support member 2 to which is by means of a transverse pivot 3 pivotally connected a carrier 4 formed by two parallel vertically extending plates to which the four wheels 5 of the unit are connected. As is apparent from FIG. 4 the wheel units are situated a short distance from the opposite ends of the transverse beam 1. In the plates forming the carrier 4 are made coaxial holes 6. Each wheel unit may be pivoted about the transverse pivot 3 so that the front wheels of the unit are lifted off the ground whereby the holes 6 are displaced into a position behind the support member 2 so that a pin can be inserted through the holes 6 whereby the unit is locked in the position with the front wheels 5 raised. Each support member 2 is formed by two coaxial tubular members of circular cross-section one of which extends into the other. This enables each of the wheel units to be turned about a vertical axis.

To steer the machine when necessary, each of the units has a forwardly extending arm, the arms being interconnected by a track rod operable by a central towing bar (FIG. 1) which may be operated e.g. hydraulically.

FIG. 2 shows an alternative embodiment of a front support formed by two track units. Each of the track units can also be turned about a transverse pivot 3. The track units are interconnected and have a common upright support member 2 which allows them to be turned about a common vertical axis. In the illustrated embodiment the lower part of the member 2 has a sideways extending arm operated by a ram, whereby the track units are steerable.

The machine further comprises a body supported at the rear by a rear support which will be described later, and at the front by the undercarriage with its front support. For the attachment to the undercarriage the body is provided with a support unit 7 formed by two angle sections extending parallel with each other transversely across the front part of the body. The webs of the two sections extend vertically and the flanges horizontally away from each other. The flanges of the transverse beam 1 extend into the space defined by the flanges of the support unit 7, and the beam 1 and unit 7 are pivotally interconnected by a longitudinal pivot 8 passing through coaxial holes in the said flanges. Due to this arrangement the undercarriage and the body may perform a rocking movement relative to each other in the transverse direction. Vertically extending guides 9 are provided on the support unit 7 to guide the ends of the transverse beam 1 during rocking.

The machine according to the invention can either be arranged to be towed or it can be self-propelled. FIG. 1 shows one embodiment of a suitable towing device in the form of wheel engagement means including two engagement assemblies each positioned at one side of the machine. Each engagement assembly includes a shaft arm 10 which extends from the side of the machine into a housing tube 11, the inner ends of the shaft arms 10 being connected, via swivable lugs, to a ram 12. Each of the engagement assemblies includes an engagement arm 13 carrying a tyre contact sleeve 14 which is rotatable about the axis of the engagement arm 13, and a wheel rim contact roller 15 which is rotatable about an axis perpendicular to the axis of the arm 13.

The sleeve 14 and roller 15 are displaceable along the arm 13 and lockable in the selected position. An additional roller (not shown), like the roller 15, may be provided, which is also displaceable and lockable on the arm 13. This additional roller serves for reversing.

In operation the two engagement assemblies are first pushed away from each other to allow a lorry (not shown) to reverse to the front part of the machine whereupon the ram 12 is operated to pull the two assemblies together so that the roller 15 of each assembly contacts the rim of the rear wheel of the lorry while the associated sleeve 14 contacts the tyre of that wheel. In this way the whole machine may be pulled by the lorry.

The body further comprises a hopper 20 adapted to receive the material to be laid from the lorry pulling the machine. The hopper 20 has a bottom 21, two side walls 22 and a front wall 23. The rear wall is formed by a bulkhead. The bottom 21 has a front portion which is substantially horizontal and an inclined portion. The front, side and rear walls are expandable by means known per se. The front wall 23 is controllable by hand levers 24 pivoted to the side walls 22 so that it can either lie on the horizontal portion of the bottom 21 or assume an inclined position shown in FIG. 1. The hopper 20 has an outlet opening shown closed by a closure plate 25 controlled by a ram 26 positioned below the inclined portion of the bottom 21. The plate 25 may close only partially.

At the rear of the hopper 20 is situated a screw conveyor including two aligned conveyor units 30. Each unit 30 comprises a shaft 31 driven by a reversible hydraulic motor 32 positioned at the inner end of the shaft. The shaft 31 carries an Archimedean screw 33 axially displaceable on the shaft 31 and rotatable therewith. The screw 33 is mounted in a bearing 34 attached to the side wall 22 of the hopper 20, so that the width of the conveyor is usually the same as the width of the hopper 20.

An extension conveyor unit 35 may be provided, the shaft of which is disconnectably connected to the shaft 31 to rotate therewith. One such extension unit 35 is shown in FIGS. 3 and 5. Each extension conveyor unit 35 is connected to the machine via a longitudinal pivot 36 so that, when necessary, the extension conveyor unit 35 can be lifted from the shown position without being disconnected from the machine. Material from the hopper 20 enters the conveyor and is thereby uniformly distributed along the whole width of the machine and any extension unit 35 attached. Each extension unit 35 has at its rear a height-adjustable levelling plate to control the thickness of the layer of the material being laid by the extension unit 35.

If no extension unit is attached, the material is conveyed sideways beyond the side walls 22 and is spread by an extension of the screed plate to be mentioned later.

The machine also comprises metering means which may be in the form of a height-adjustable screed plate 40 (FIGS. 1, 6 and 8). The illustrated screed plate 40 is substantially L-shaped in section and has a first portion 41 which is substantially upright and a second portion 42 which extends substantially at right angles to the first portion. The transverse edge at the bottom of the front part of the second portion 42 is the leading edge of the screed plate 40, and the edge at the rear part of the second portion, parallel with the leading edge, is the trailing edge of the screed plate 40. The front portion of the screed plate 40 is suspended from front rams 43, while the rear portion is suspended on rear rams 44.

The rams 43, 44 are independently adjustable and operable, although usually only the rams 43 are operated independently of each other, while the rams 44, after having been adjusted to the required height, remain fixed in their adjusted position. The rams 43, 44 are interconnected by a frame 49 which is, via a ram 50, transversely displaceable relative to the rest of the body in a front guide 45 by means of rollers 46 (FIG. 6) and in a rear guide 47 by means of rollers 48. In view of this arrangement the screed plate 40 is also transversely displaceable and can thus avoid any obstacles and allow for necessary adjustment.

In the vicinity of each end of the screed plate 40 is a link member 51 (FIG. 1) connected pivotally by longitudinal pivots to the upright portion 41 and an upright extension above the trailing edge. To the link member 51 are pivotally connected, via anti-vibration units 52, the lower ends of the rams 43, 44. The part 42 of the screed plate 40 carries vibrators 53.

The screed plate 40 is hollow and contains at each end an extension frame 54 (FIG. 6) which can be pulled out sideways and be fixed in position. Bottom plates 55 are fitted to the bottom of the extended part of the frame 54. Height-adjustable side plates 57 may be fixed to the outer ends of the frames 54 to delimit the width to which material is fed by the screw conveyor.

Perforated heating tubes pass through the screed plate 40 for its heating when e.g. bituminous material is laid. The inlet ends 56 of the tubes are shown in FIG. 6.

The side plates 22 are extended to a rear bulkhead 60 (FIG. 3) which serves as a guide for cantilever members 61 which are connected to the plates 22 and facilitate their expansion. The cantilever members 61 may be supported on rollers (not shown) in the bulkhead 60. Similar guides and cantilever members for guiding the plates 22 are provided elsewhere. All members 61 may be locked in position.

Connected to the bulkhead 60 (FIG. 1) in the vicinity of each of its ends is an outer tube 62 containing an inner tube 63 guided telescopically therein. Each inner tube 63 contains a ram 64 for height-adjustment of the rear support. The rams 64 are independently adjustable and operable. To the bottom of each inner tube 63 is by a longitudinal pivot 65 connected an outer saddle 66. The outer saddles 66 (FIGS. 1 and 5) are interconnected by four parallel beams 67 which carry inner saddles 68. In the saddles 66, 68 are mounted rollers 69 for free rotatable mounting of two rear support rollers 70. Extension rollers (not shown) may be attached to the outer ends of the rollers 70.

A water tank 71 is attached to the bulkhead 60 so that water may be sprayed onto the rollers 70 to prevent the material being laid from adhering to the rollers 70.

Guides for the tailboard of the towing lorry may be provided in the upper part of the machine.

A prime mover, such as an internal combustion engine or a battery-operated electric motor, drives a hydraulic pump (not shown) which, via controls 79, supplies the various rams and hydraulic motors with pressurised liquid. It will be understood that instead of hydraulic equipment, or in addition thereto, the various rams and motors may be operated by compressed air. Instead of some of the rams a mechanical device, such as a screw and nut, may be used.

As is apparent from FIGS. 5 and 7, the upper rear beams 67 and the upper front beams 67 are interconnected pivotally by a common pivot 72, while the lower rear beams 67 are connected, via a pivot 73 each, to a turnbuckle 74. The lower front beams 67 are interconnected in the same way. The arrangement, together with the pivots 65, enables the saddles 66, 68, and consequently the rollers 70, to be crowned, as shown in FIG. 7. Naturally the crowning can be inverted or be one-sided.

As shown in FIGS. 6 and 8, the screed plate 40 is composed of two halves interconnected, via pivots 75, by a turnbuckle 76 at the rear (FIG. 8) and at the front (not shown), and also by a bottom plate 77. This arrangement, together with the pivots at the bottom of the link members 51 enables the screed plate 40 to be crowned as shown in FIG. 8. Inverted or one-sided crowning are also possible. A cover plate 78 prevents material from penetrating into the gap between the crowned halves.

FIG. 9 shows the machine of FIG. 1 adapted for laying a thin layer of material. For this purpose a roller 80 is mounted in suitable bearings (not shown) and driven by the hydraulic motor or motors 32. The surface of the roller 80 may be e.g. provided with axial or helical peripheral grooves or covered with a mesh to provide a plurality of relatively shallow recesses or cavities which are filled by the material to be laid as the roller 80 rotates. In this embodiment the closure plate 25 or some similar plate, and a further plate held by the screed plate 40 are used as doctor blades for the roller 80. The roller 80 may also be adapted for feeding liquid material for providing anti-skid surfaces. Generally when the roller 80 is used it assumes the function of the metering means, although in some circumstances it may be used in combination with the screed plate 40 serving as a further metering means.

FIG. 10 shows two alternative embodiments of the rear support. Instead of the rear support rollers 70 either skids 81 travelling on the laid surface, or kerb rollers 82 travelling e.g. on kerbstones or kerb shuttering are used. In this Figure the screed plate 40 is shown in a lifted position.

A machine according to the invention preferably includes profiling means for keeping the screed plate 40 and the rear support, e.g. the rollers 70, at the desired height from, and at the desired angle relative to the base onto which the material is laid.

The illustrated profiling means includes two separate units, each positioned at or in the vicinity of one side of the machine. One or both units may be, for instance, a spirit level unit 85 or a pointer unit 86. Two units 85 or two units 86, or one unit 85 and one unit 86 may be positioned on a suitable part of the screed plate assembly or of the rear support assembly, or one unit on one of the assemblies and the other unit on the other assembly. Examples are shown in FIGS. 6 and 11.

The pointer unit shown in FIG. 11 has an upright arm provided with a plurality of openings for its attachment to the machine at a desired height, and a transverse arm which may be set to be in light contact with the kerbstone serving as a reference line. The reference line may also be formed by other means, e.g. a laser beam. For instance the change of the pressure exerted by the pointer onto the kerbstone or its displacement relative to the kerbstone or the laser beam may be used for automatic control.

The spirit level unit 85 shown in FIG. 12 includes a spirit level including a tubular body 87 of rectangular cross-section containing at each end a disc 88. Each disc 88 is provided with a radially extending threaded hole which accommodates a screw 89 guided between two parallel uprights 90, so that the body 87 may either be completely withdrawn or inclined at a desired angle. Behind the body 87 is a series of parallel lines 91 which serve as a scale for angular adjustment of the body 87 and consequently of the spirit level. Other scales may naturally be used. The angles are indicated, as customary in civil engineering, as a gradient, i.e. fall or rise per unit horizontal for determining the crossfall of the road.

Additionally or alternatively, the unit 85 and/or 86 may be provided on the extension conveyor unit 35.

For the adjustment shown in FIGS. 13 and 14 the spirit level unit 85 is set to the desired gradient and the pointer unit 86 to the desired height above the road base.

As is apparent from FIGS. 5 to 8 the whole machine, and particularly the screed plate 40 and the rear support roller 70, are substantially symmetrical with respect to a vertical plane passing longitudinally through the middle of the machine. Consequently for the adjustment shown in FIG. 15 the spirit level unit 85 is so set that only the half of the screed plate 40 or roller 70 with which it is associated is adjusted to the desired crown angle, while the pointer unit 86 is adjusted to the desired height.

FIG. 16 shows the spirit level unit 85 on an extension of the screed plate 40 or roller 70 to enable angular setting of the screed plate 40 and roller 70 relative to the extension conveyor unit 35, and then with the single unit 85 adjustment is made in the manner described in connection with FIGS. 13 and 14 for the road, which provides automatically and simultaneously also the correct adjustment for the pavement.

FIG. 17 shows the front support travelling on the road base to be provided with a layer of the material, and the rear support on the surface laid by the machine, i.e. the surface which has been metered by the leading edge and pre-compacted by the trailing edge of the screed plate 40, and compacted by the roller 70. Due to the fact that the roller 70 moves on the finished laid surface, which is even, unevenness of the road base on which travels the front support is only partially transmitted to the screed plate 40 as indicated by the dashed lines.

In addition a similar limited transmission of the unevenness of the road base is obtained by the rockable connection between the undercarriage and body by means of the longitudinal pivot 8 as is shown in FIG. 4.

At least theoretically, due to the provision of the pivot 8 in the middle between the two wheel units only 50% of the vertical displacement of one of the wheel units relative to the other due to unevenness of the road base is transmitted to the pivot 8 and consequently on the front end of the body, and of these 50% only about a half, i.e. about 25% of the total, is transmitted to the leading edge of the screed plate 40, which is approximately in the middle between the front and the rear support. Naturally the nearer the leading edge is to the rear support roller 70 the smaller is the inaccuracy transmitted to the screed plate 40.

For setting the machine the front rams 43 and the rear rams 44 for the screed plate 40 and the rams 64 for the rear support roller 70 are associated each with a scale for their independent adjustment, the scales being in a pre-selected mutual relationship. This relationship may be e.g. such that if the leading edge, the trailing edge and the roller 70 rest on a horizontal plane along the whole length all the pointers cooperating with the respective scales point to zero.

In practice the screed plate 40 will be so adjusted that its leading edge is higher than its trailing edge, while the roller 70 is lower than the trailing edge. In this setting the leading edge meters, the trailing edge pre-compacts and the roller 70 compacts.

While usually the setting of the trailing edge and roller 70 remains constant during forward travel of the machine the leading edge is continually readjusted independently on either side thereof, either manually or automatically to compensate for the unevenness of the road base influencing the front support which travels thereon and partially transmitted to the screed plate 40.

The roller 70 may be vibrated or be arranged to be filled with water. The screed plate 40 or the levelling plate may be transversely profiled and the roller 70 shaped correspondingly. The hopper 20 may be subdivided into compartments or pressurised to force the material out. Instead of the unit 85 another adjustable levelling or plumbing unit may be used, e.g. a tube including a ball or a substantially U-shaped water level with floats, the unit on deviation from the desired position actuating sensing means, such as micro-switches or photocell units, which, via known automatic control means, cause corresponding readjustment of e.g. the leading edge to the correct position.

I claim:

1. A road surfacing machine arranged for movement along a road to be surfaced, the machine comprising a body including a hopper for storing material to be laid and outlet means for allowing the discharging of the material from the hopper, a front support and a rear support arranged to support the machine, the front support being situated to travel on the uneven ground to be surfaced, the rear support being situated to travel on the surface laid by the machine, metering means, positioned between the front and rear supports for forming a layer of selected thickness and shape of the material discharged from the outlet means, first bearing means on the front support for free relative angular displacement between the front support and the rest of the machine about a longitudinal axis contained in or parallel to a vertical plane of symmetry of the machine, and second bearing means on the front support for free relative angular displacement between the front support and the rest of the machine about a transverse axis perpendicular to the vertical plane of symmetry of the machine.

2. The machine according to claim 1 including first adjustment means for adjustment of height and transverse inclination of the rear support relative to the front support.

3. The machine according to claim 2 wherein the rear support includes two rollers extending next to each other transversely, and the metering means includes a screed plate which is composed of two parts extending next to each other transversely, the machine including a second adjustment means operatively associated with the two screed plate parts for adjustment of their transverse inclination relative to each other, and third adjustment means operatively associated with the two rollers for adjustment of their transverse inclination relative to each other, in conjunction with the two screed plate parts.

4. The machine according to claim 3 including fourth and fifth adjustment means each operatively associated with one of the two screed plate parts, each for adjustment of the lengthwise inclination of the associated screed plate.

5. A machine according to claim 1 including means for transversely displacing the metering means relative to the rest of the machine.

6. A machine according to claim 1 wherein the transverse axis is formed by at least one pivot interconnecting a lower part of the front support with an upper part of the front support, while the longitudinal axis is formed by a longitudinal pivot interconnecting the front support with the rest of the machine.

7. The machine according to claim 2 including first indicating means operatively associated with the metering means for indicating the height of the latter relative to the front support, second indicating means operatively associated with the metering means for indicating the angle of transverse inclination of the latter relative to the front support, third indicating means associated with the rear support for indicating the height of the latter relative to the front support, and fourth indicating means associated with the rear support for indicating the angle of transverse inclination of the latter relative to the front support.

8. The machine according to claim 7 wherein the angle indicating means is an adjustable leveling unit.

9. The machine according to claim 7 including sensors for sensing deviation of said angle indicating means from the desired position, and further including automatic control means actuated by said sensors to cause readjustment of the metering means via the fourth and fifth adjustment means, whereby said rear support is maintained in the desired position.

10. A machine according to claim 1 wherein the metering means has an extension projecting beyond the width of the machine, and including profiling means and means for indicating the height of the metering means.

* * * * *